United States Patent [19]

Helwig, Jr.

[11] 4,331,484

[45] May 25, 1982

[54] ENERGY SAVING DISHWASHING METHOD WITH HEATER CONTROL

[76] Inventor: William F. Helwig, Jr., 6731 Briargate, Downers Grove, Ill. 60516

[21] Appl. No.: 207,725

[22] Filed: Nov. 17, 1980

Related U.S. Application Data

[62] Division of Ser. No. 77,135, Sep. 19, 1979, Pat. No. 4,254,788.

[51] Int. Cl.[3] ..... B08B 3/10

[52] U.S. Cl. ..... 134/18; 134/25.2

[58] Field of Search ..... 134/57 D, 58 D, 107, 134/108, 18, 25.2

[56] References Cited

U.S. PATENT DOCUMENTS

| | | | |
|---|---|---|---|
| Re. 25,486 | 11/1963 | Nolte | 134/25.2 |
| 3,847,666 | 11/1974 | Jacobs | 134/108 X |
| 3,982,552 | 9/1976 | Fraula | 134/57 D |
| 4,134,003 | 1/1979 | Hahn | 134/57 D X |
| 4,159,211 | 6/1979 | Hoffman et al. | 134/57 D |

*Primary Examiner*—Richard V. Fisher

[57] ABSTRACT

A control circuit for a dishwashing machine to economize its energy consumption and usage. In order to conserve energy, the dishwashing machine has a control system for automatically actuating the components such as the heating elements of the dishwashing machine.

1 Claim, 1 Drawing Figure

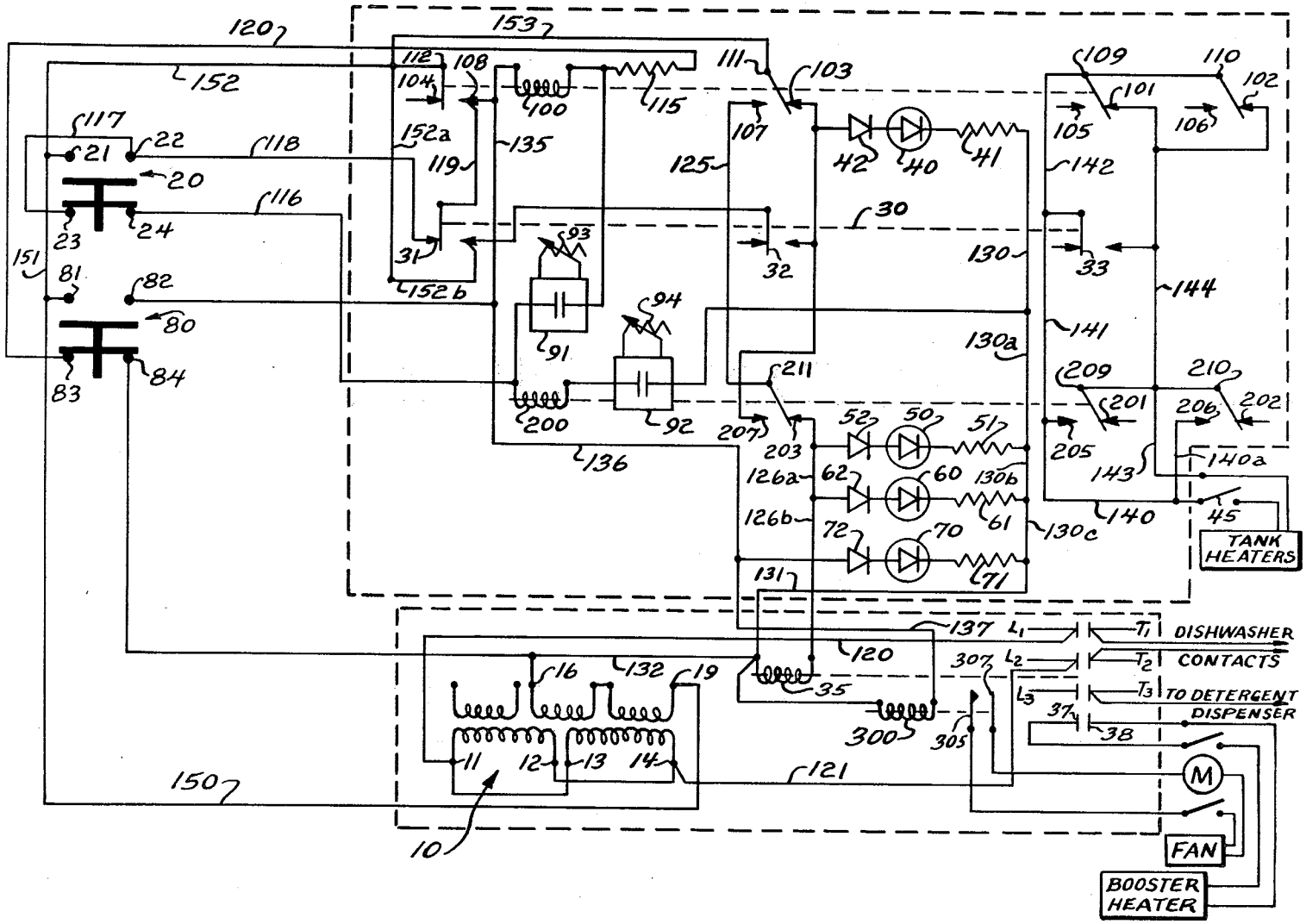
TANK HEATERS
DISHWASHER CONTACTS
TO DETERGENT DISPENSER
FAN
BOOSTER HEATER

ENERGY SAVING DISHWASHING METHOD WITH HEATER CONTROL

This is a division of application Ser. No. 77,135, filed Sept. 19, 1979, now U.S. Pat. No. 4,254,788.

BACKGROUND OF THE INVENTION

This invention relates in general to a dishwashing machine and, in particular, to a control system for automatically actuating the operating components of a dishwashing machine such as dishwasher pumps, conveyor motor, exhaust fan motor, booster heaters and tank heaters.

More specifically, this invention relates to a dishwashing machine control system whereby energy consumption of a dishwashing machine is reduced by controlling the operation of various operating components of the machine.

Commercial dishwashing machines, such as are widely used in restaurants, generally involve a plurality of operator initiated steps such as, for example, closing drain valves; opening fill valves; filling tanks to the proper levels; actuating tank and booster heaters and so forth. Generally, prior art commercial dishwashing machines must be operated for sustained periods of time with considerable waste of electrical energy.

Due to the fact that it is both time-consuming and inefficient to continually turn the machine on and off as use is desired, the dishwashing machine is commonly turned on in the morning and remains in continuous operation until the last dishwashing operation is completed. Since the dishwashing machine is only used intermittently during the course of the day, there are times during the day when the machine is energized and not in use. During this time, the heating elements are actuated to maintain the temperature of the water at a desired level to provide sufficient hot water for the various cycles of the dishwashing machine. Also, various other components of the dishwashing machine such as the conveyor dishwasher motor, pumps and exhaust fan motor also remain electrically actuated. Because of the continuous operation of these heaters and various other components, the dishwashing machine needlessly consumes electrical energy increasing the cost of its operation and being counter-productive to the national objective of energy conservation.

In order to accomplish an effective and efficient washing operation, hot water is generally dispensed in prior art dishwashing machines onto the dishes during a pre-wash cycle which occurs as soiled dishes enter the machine. Such known dishwashing machines often have tank heaters which heat the water for the pre-wash cycle of the dishwashing machine. However, the tank heaters require actuation before any dishes enter the machine, because the water must be sufficiently hot to pre-wash the dishes as they enter the machine thereby requiring the tank heater to be on and ready all the time. Dishwashing machines in the prior art also have booster heaters which provide hot water for the final rinse spray when the soiled dishes reach the final rinse cycle. These booster heaters require costly energization as soon as the washing cycle was commenced to provide sufficiently heated water for the final rinse cycle.

In previous dishwashing machines, the on-off cycle of these heaters was independent of the washing and rinsing operations of the dishwashing machine, thereby both the booster heater and the tank heaters had to be continually energized to insure that the machine always had a sufficient supply of hot water as it was needed.

Such simultaneous operation of both heating elements, the booster heater and the tank heater, results in a costly increase in the kilowatt hour and energy demand required by the dishwashing machine.

SUMMARY OF THE INVENTION

It is, therefore, an object of this invention to improve dishwashing machines.

Another object of this invention is to utilize a control system for automatically actuating components of a dishwashing machine.

A further object of this invention is to conserve energy by reducing the operating time of the dishwashing machine and heating elements.

Still another object of this invention is to prevent simultaneous operation of the heating elements.

Another object of this invention is to render the heating elements dependent on machine operation.

A further object of this invention is to actuate the heating elements in a sequential order of the machine operation.

These and other objects of the invention are attained in accordance with the present invention wherein there is provided a control circuit to economize energy consumption of a dishwashing machine.

The control circuit of the present invention prevents both heater elements from operating simultaneously thereby resulting in a favorable reduction of KWH and energy demand required by the system, thereby reducing the utility dollar.

The control circuit of the dishwashing machine causes the tank heaters to be actuated when the machine is turned on to remain in a heated state until soiled dishes enter the machine whereby the water heated by the tank heater is dispensed for pre-washing. The tank heater then is deactivated, because there is no longer a need for hot water for pre-washing until a subsequent washing cycle. As the dishes enter the machine such as on a rack moved by a conveyor, the booster heaters are energized to heat water for the final rinse. By the time the dishes reach the final rinse cycle, the water is heated to the desired temperature level thereby providing the required hot water for the final rinse. The hot water will then be dispensed for the final rinse of the rack of soiled dishes. The rack will then exit the machine thereby turning the booster heaters off and turning the tank heater back on thus rendering the machine ready for another rack to enter.

The foregoing operation effected by the control circuit of the application results in significant energy conservation as compared to prior art devices.

BRIEF DESCRIPTION OF THE DRAWING

These and other objects and advantages of the present invention will become more fully apparent from the following detailed description when read in conjunction with the accompanying drawing in which there is shown a schematic diagram of an electical control system for a dishwashing machine to control the energy demand and usage of the machine.

DESCRIPTION OF A PREFERRED EMBODIMENT OF THE INVENTION

Referring to the drawing, there is shown a suitable control circuit for a dishwashing machine to facilitate control of energy during operation of the machine.

Although the circuit of the invention is described for convenience of illustration with use in a rack conveyor dishwashing machine, the invention is not intended to be so limited and may be used with other types of dishwashing machines where economy of operation is desired. Lines $L_1$, $L_2$ and $L_3$ shown in the FIGURE are electrical power lines connected to a suitable source of electrical power (not shown) to operate the components of a dishwashing machine such as, for example, a rack conveyor dishwashing machine.

Before racks containing soiled dishes are inserted into a dishwashing machine controlled by the circuit of the present invention, a main power switch (not shown) is turned to the on position to commence operation of the dishwashing machine, and a by-pass switch 30 is put into the automatic mode where by-pass switch contacts 31, 32 and 33 are in the position as illustrated in the FIGURE. Independently, a tank heater thermostat switch 45, a booster heater thermostat switch 65 and a fan motor switch 75 are also actuated. The rack conveyor dishwashing machine has tank heaters which are coupled to the control circuit where indicated in the drawing and are energized when the tank heater thermostat switch 45 is closed thereby allowing electrical current to pass through electrical leads 140 - 141 - 142 into normally closed contacts 109 - 101 and 110 - 102 through leads 144 - 143 and back to the tank heaters. The tank heaters function to maintain water temperature at a desired level to provide hot water for prewashing a rack of soiled dishes. It is essential that the tank heaters are started when the main power switch is actually turned on, so that the water will be sufficiently heated when the rack containing soiled dishes enters the machine to be pre-washed.

A tank heater indicator 40 is energized when the main power switch is activated to evidence the fact that the tank heaters are operating. Electrical current flows into the previously mentioned main power switch through Lines $L_1$ and $L_2$ and then passes to a multi-turn voltage transformer 10 through leads 120 and 121, respectively. The current through lead 120 is directed to contacts 11 and 13 of voltage transformer 10, and the current through lead 121 is coupled to contacts 12 and 14 of the voltage transformer 10 which steps down voltage. The current then flows out of the voltage transformer 10 at contact 19 and passes through lead connections 150 - 151 - 152 - 153 and then through normally closed contacts 111 - 103, a blocking diode 42 and a resistor 41 thereby driving the tank heater indicator 40 which is a light emitting diode (LED). The LED is displayed on a control box (not shown) for visual inspection by the operator. The current returns through the lead connections 130 - **130*a* - 130*b* - 130*c* - 131 - 132 back to the voltage transformer 10 at contact 16**.

In order to commence the cycle of operation of a dishwashing machine, a rack containing soiled dishes is inserted into the machine. Upon the insertion of the rack into the dishwashing machine, a start switch 20 which is mounted on a soiled dishtable (not shown) at the entrance of the dishwashing machine, is actuated thereby opening normally closed contacts 23 - 24 and closing normally open contacts 21 - 22. The current now flows out of the voltage transformer at contact 19, through the leads 150 - 151, into the start switch 20 and through contacts 21 - 22 and then through lead 118 to the by-pass switch contacts 31 and proceeding through lead 119 to thereby energize a relay 100. The current returns through a limiting resistor 115, through lead 120 to normally closed contacts 83 - 84 of a table limit switch 80 and back to contact 16 of the voltage transformer 10. Since the water temperature maintained by the tank heaters is at the desired temperature level, the tank heaters are no longer needed, whereby the heated water is dispensed as the rack of soiled dishes enters the dishwashing machine to pre-wash the rack of soiled dishes for more effective washing of the dishes.

When relay 100 is energized, normally open contacts 110 - 106 and normally open contacts 109 - 105 are closed thereby turning off the tank heaters. Normally, open contacts 111 - 107 are now also closed thereby de-energizing the tank heater indicator 40.

The tank heaters remain off during the time that the rack of soiled dishes passes through the machine in a washing operation thereby conserving considerable amounts of energy.

After totally energizing, relay 100 latches through its own normally open contacts 112 - 108 which have now closed. The current that formerly drove the tank heater indicator 40 now flows through closed contacts 111 - 107, through lead 125, through normally closed contacts 211 and 203, through lead connections **126*a* - 126*b* to a relay 35 which is thereby energized closing the contacts and starting the dishwashing machine, the pumps, the conveyor and the detergent dispenser transformer. The current then returns through lead 132 to contact 16 of the voltage transformer 10. A dishwashing machine indicator 50 also receives current through contacts 111 - 107, through lead 125 and normally closed contacts 211 and 203, and then through a blocking diode 52 and a limiting resistor 51 thereby driving the dishwasher indicator 50, which is an LED. This LED is also displayed on the control box for visual inspection by the operator. The current then returns through leads 130*b* - 130*c* - 131 - 132 to contact 16 of the voltage transformer 10**.

Booster heaters are energized through the normally open contacts 37 - 38 which were closed when relay 35 was energized and the booster heater switch 65 which was turned on when the main power switch was activated. The booster heaters maintain water at desired temperature to supply hot water for the final rinse spray when the rack of soiled dishes reaches the final rinse cycle. Thus, as the rack of soiled dishes enters the machine, and relay 100 is energized thereby energizing relay 35, the booster heaters will start up and begin heating the water for the final rinse. The booster heaters will only operate when the rack of soiled dishes is in the machine, and it will automatically turn off as the rack of soiled dishes exits the machine.

Effectively, the booster heaters and the tank heaters will never operate simultaneously thereby conserving considerable amounts of energy. A booster indicator 60 also receives current from contacts 111 - 107, through lead 125, through contacts 211 - 203, through a blocking diode 62 and a limiting resistor 61 thereby driving booster heater indicator 60, which is an LED displayed on the control box for visual inspection by the operator. The current then returns through lead connections **130*c* - 131 - 132 to contact 16 of the voltage transformer 10**.

Since normally open contacts 112 and 108 are now closed, the current flows through those contacts and then through lead connections 135 - 136 - 137 to a relay 300 thereby energizing it. When relay 300 is energized, normally open contacts 305 - 307 are now closed thereby energizing a fan motor, since fan motor switch 75 was closed when the main power switch was turned on. A fan indicator 70 is also turned on through contacts 112 - 108, leads 135 - 136 and then through a blocking diode 72 and a limiting resistor 71 thereby driving fan indicator 70, which is also an LED displayed on the control box for visual inspection by the operator. The current returns through leads 131 - 132 to contact 16 of the voltage transformer 10.

The rinse injector and solenoid are supplying power to dishwashing machine contacts $T_1$ and $T_2$ which are now energized when relay 35 was energized and are turned on through their own control circuitry.

After the rack containing the soiled dishes clears the start switch, the start switch 20 automatically resets, and contacts 21 - 22 open and contacts 23 - 24 now close. However, all energized components remain energized, since relay 100 remains latched. The current in lines 150 - 151 - 152 now goes through contacts 112 - 108, through lead 119, and passes through by-pass switch 31. The current continues to flow through lead connections 118 - 119, and passes through now closed contacts 23 - 24 of the start switch 20, and then goes through line 116 to a relay 200 supplying power to a timer 92, which begins the delay to close the timing contacts of timer 92. The length of the delay of timer 92 is dependent on the setting of a potentiometer 94 associated with timer 92. The length of the delay is usually the time to allow the rack to exit the dishwashing machine.

At a time just prior to the end of the delay of timer 92, a final rinse solenoid is energized thereby dispensing the water heated by the booster heater for the final rinse spray just as the rack of soiled dishes is nearing the end of the rinsing operation of the dishwashing machine. After the delay elapses, the contacts of timer 92 close, whereby relay 200 is energized.

The rack has now exited the machine, so the need for the operation of various heaters has ceased. Thus, when relay 200 is energized, normally closed contacts 211 - 203 swing to the open position thereby turning off the dishwasher contactor, pumps conveyor, detergent dispenser, dishwasher indicator 50, booster heater and booster indicator 60.

The tank heaters are turned on, when relay 200 is energized, as normally open contacts 205 - 209 and normally open contacts 210 - 206 are also closed. The current now flows through leads 140 and **140*a*, through contacts 205 - 209 - 206 - 210, respectively, and then unites to flow through lead 143** to the tank heaters.

The tank heater indicator 40 is also again turned on to show that the tank heaters are on. The current flows through contacts 111 - 107, through lead 125, through contacts 211 - 207, through lead 124 to a blocking diode 42 and limiting resistor 41 thereby driving the tank heater indicator 40. The current then returns through lines **130 - 130*a* - 130*c* - 131 - 132 to contact 16 of the voltage transformer 10. The current that was provided to timer 92 was also provided to timer 91 through lead 116 and thus, timer 91 began timing at the same time as timer 92**.

There is, however, a need for the fan to remain energized for a short period after the other components are turned off to insure that all the condensation is removed from the dishes. The extra delay is provided for by a timer 91 as a potentiometer 93 is set for a longer delay than the potentiometer 94 of timer 92. When the contacts of timer 92 close, thereby energizing relay 200 and turning the various components of the dishwashing machine off, the fan and the fan indicator remain energized as they receive their power through relay 300 which has remained energized. Thus, the contacts of timer 91 will close at a time subsequent to the time when the contacts of timer 92 close. After the contacts of delay timer 91 close, relay 100 will short out. The current through timer 91 is limited through resistor 115 and, therefore relay 100 de-energizes. When relay 100 de-energizes, normally open contacts 112 - 108 will open thereby shutting off power to all relays and timers and returning the circuits to the stand-by mode. The tank heaters and tank heater indicator 40 remain on, and the dishwashing machine is ready for another rack to enter it.

The dishwashing machine also has the table limit switch 80, which is mounted on the clean dishtable (not shown), to de-energize all dishwasher motors, detergent dispenser, final rinse solenoid, rinse injector and booster heater in the event of a rack backup into the dishwashing machine opening. The table limit switch 80 can be actuated during any part of the cycle. When actuated, normally open contacts 81 - 82 will close, and normally closed contacts 83 - 84 will open thereby providing power to relay 300. The current flows from the table limit switch 80 through leads 135 - 136 to the fan indicator 70 and also through lead 137 thereby energizing relay 300 to close the normally open contacts 305 - 307 to start the fan. When normally closed contacts 83 - 84 of table limit switch 80 are open, relay 100 is turned off thereby de-energizing all other components. When the table limit switch 80 is released, the contacts 83 - 84 close whereby the relay 300 loses power, and the fan operation ceases. However, when the table limit switch 80 is activated, in order to have the dishwashing machine ready to restart, the start switch 20 must be manually operated to begin operation of the dishwashing machine.

During certain peak periods of operation, it is both desirable and more efficient for the dishwashing machine and its various components to be in continual operation. The dishwashing machine has a by-pass switch 30 to provide for the continual operation.

When continual operation is desired, the by-pass switch 30 is turned to the manual position thereby closing the normally open by-pass switch contacts 31, 32 and 33. The current that flows through the by-pass switch contacts 31 energizes relays 100 and 300 and disconnects relay 200 and timers 91 and 92 thereby allowing the dishwasher contactor, conveyor pumps, booster heater, detergent dispenser, fan, dishwasher indicator 50, water indicator 60 and fan indicator 70 to remain on. The by-pass switch contacts 32 turn the tank heater indicator 40 on while the by-pass switch contacts 33 turn the tank heaters on. Upon activation of the table limit switch 80 at any time during this by-pass operation, all functions are de-activated except the tank heater and the fan. However, all functions of the dishwashing machine are re-activated when the table limit switch 80 is released.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A method of conserving energy during the operation of a dishwasher machine, comprising the steps of supplying electrical power to a dishwasher machine having a booster heater and a tank heater for commencing an operative cycle of the machine, controlling the supply of electrical power to the dishwasher machine to activate the tank heater and to prevent simultaneous activation of the booster heater, interrupting the supply of electrical power to the tank heater at the start of a washing cycle of the operative cycle of the dishwasher machine, controlling the supply of electrical power to the booster heater simultaneous with the interruption of electrical power to the tank heater to activate the booster heater and to prevent simultaneous activation of tank heater, and interrupting the electrical power supplied to the dishwasher after a predetermined time interval after the commencement of said operative cycle.

* * * * *